United States Patent [19]

Stackhouse

[11] Patent Number: 4,735,033

[45] Date of Patent: Apr. 5, 1988

[54] WIPE DOWN ARRANGEMENT FOR WRAPPING APPARATUS

[75] Inventor: William H. Stackhouse, Louisville, Ky.

[73] Assignee: Lantech, Louisville, Ky.

[21] Appl. No.: 929,842

[22] Filed: Nov. 13, 1986

[51] Int. Cl.[4] ..... B65B 11/04

[52] U.S. Cl. ..... 53/399; 53/441; 53/556; 53/587

[58] Field of Search ..... 53/556, 587, 588, 399, 53/441; 15/119 R, 228, 230.14, 230.16

[56] References Cited

U.S. PATENT DOCUMENTS 1,398,245 11/1921 Toplitz ..... 15/229 R
2,023,021 12/1935 Jenkins ..... 15/119 R
2,200,808 5/1940 Purvis ..... 15/228
2,983,940 5/1961 Olsen ..... 15/230 X
4,563,863 1/1986 Humphrey ..... 53/556

*Primary Examiner*—John Sipos
*Attorney, Agent, or Firm*—Finnegan, Henderson, Farabow, Garrett & Dunner

[57] ABSTRACT

An arrangement for wiping down a web wrapped on a load includes a wiper support and a wiper including at least one strip doubled back along its length to form a loop, the loop being flexible in a direction generally parallel to a plane passing through the length of the strip, the wiper being secured to the wiper support and the loop extending from the wiper support for wiping down the web wrapped on the load by relative movement between the wiper support and the web in the direction generally parallel to the plane passing through the length of the strip.

26 Claims, 3 Drawing Sheets

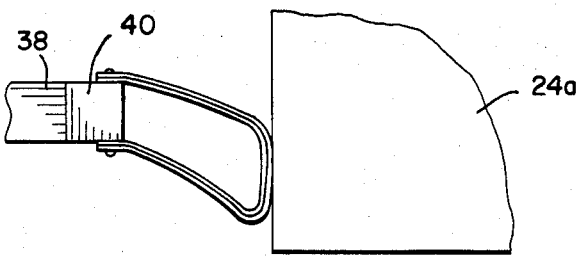
FIG 4A
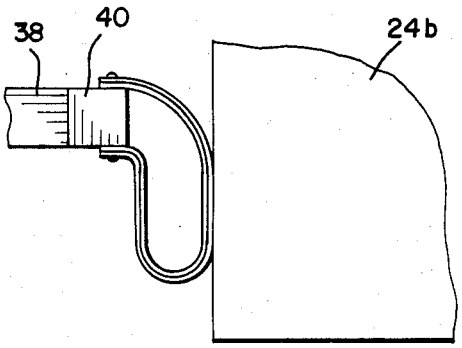
FIG 4B
FIG 5A
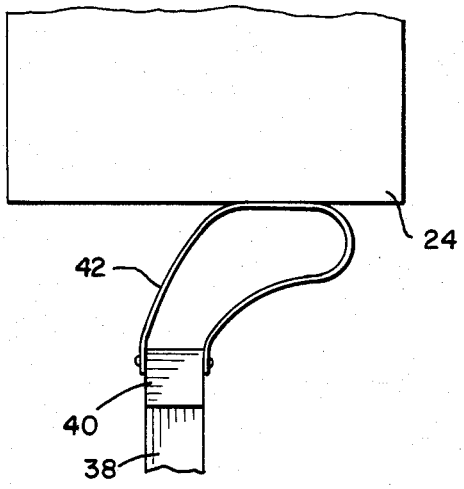
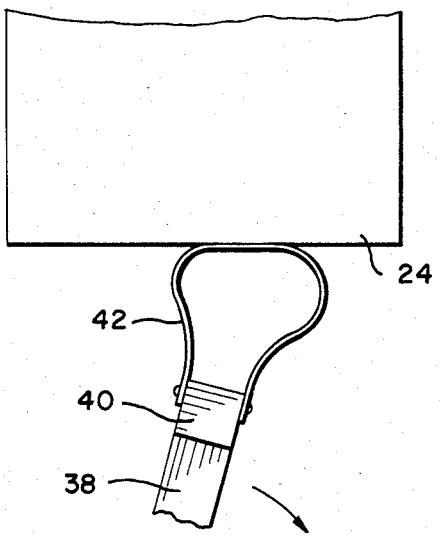
FIG 5B
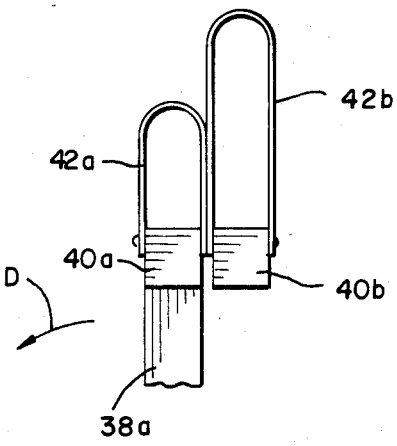
FIG 7

WIPE DOWN ARRANGEMENT FOR WRAPPING APPARATUS

BACKGROUND OF THE INVENTION

The present invention relates to packaging and more particularly to a device for wiping down a web wrapped on a load.

Machines which are designed to wrap a load with a stretched web to cover and contain the load with a stretched layer of film are generally known as stretch wrapping machines. Examples of such machines are disclosed in U.S. Pat. Nos. 4,232,501 and 4,300,326 to Stackhouse and assigned to Lantech, Inc. These patents and the U.S. patents cited in these references are incorporated herein by reference.

After automatically wrapping a load with a film web, the trailing end of the web needs to be wiped down on the load so that it comes in contact with and becomes adhered to an underlying layer of web. In the past, such wipe down arrangements involved the use of a bristle brush attached to a support which moved relative to the trailing end of the web and the load such as the arrangement shown in U.S. Pat. No. 4,232,501.

However, such arrangements, while effective, offer a number of drawbacks. Bristle brushes provide optimum stiffness only within a very narrow range of distances from the load. As a result, the positioning of the conventional bristle brush would have to be reset when wrapping loads of various sizes. This drawback is of particular significance in automatic, continuous wrapping procedures which would otherwise need little intervention by a human operator.

Another drawback of conventional brush arrangements is that the brush would generally need to be articulated about more than one axis in order to adequately position the brush relative to the wrapped load.

An additional drawback of conventional bristle brushes is that the bristles fatigue, bend and sag after a period of use and therefore need to be replaced after such periods of use.

A further drawback of the conventional brush arrangements is that the brush does not conform to the surface of products having a non-regular shape and, as a result, do not insure a complete wipe down along the whole width of the trailing end of the web.

Another drawback of conventional brush arrangements is that the brush needs to encounter the web at a particular angle and with a particular motion in order to effectively wipe down the web and prevent the bristles from piercing and tearing the web.

Accordingly, it is an object of the present invention to provide a wipe down device which has an extended range over which it can reach automatically in order to accommodate loads of varying sizes.

It is another object of the present invention to provide a wipe down device which does not fatigue or bend vertically after an extended period of use.

It is a further object of the present invention to provide a device which conforms to irregularly shaped products to insure wipe down along the whole width of the web.

It is another object of the present invention to provide a simple relative motion between the wipe down device and the web and load.

It is an additional object of the present invention to provide a wipe down device which effectively wipes down the trailing end of the film web over a wide range of angles and wiper wipe down motions without piercing or tearing the web.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

SUMMARY OF THE INVENTION

To achieve the foregoing objects, and in accordance with the purposes of the invention as embodied and broadly described herein, there is provided an apparatus for wiping down a web wrapped on a load comprising: a wiper support; and a wiper including at least one strip doubled back along its length to form a loop, the loop being flexible in a direction generally parallel to a plane passing through the length of the strip, the wiper being secured to the wiper support and the loop extending from the wiper support for wiping down the web wrapped on the load by relative movement between the wiper support and the web in said direction.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

FIG. 4A is a top view of the arrangement shown in FIG. 3 as it engages a narrow load;

FIG. 4B is a top view of the arrangement shown in FIG. 3 as it engages a wide load;

FIGS. 5A through 5B are top views of the arrangement shown in FIG. 3 illustrating a sequence of operations;

FIG. 7 is a top view of another embodiment of a wiper and wiper support incorporating the teachings of the present invention.

DESCRIPTION OF THE PREFERRED EMBODIMENTS

Reference will now be made in detail to the present preferred embodiments of the invention as illustrated in the accompanying drawings.

In accordance with the present invention, there is provided an apparatus for wiping down a web wrapped on a load comprising: a wiper support; and a wiper including at least one strip doubled back along its length to form a loop, the loop being flexible in a direction generally parallel to a plane passing through the length of the strip, the wiper being secured to the wiper support and the loop extending from the wiper support for wiping down the web wrapped on the load by relative movement between the wiper support and the web in said direction.

Figure 1:
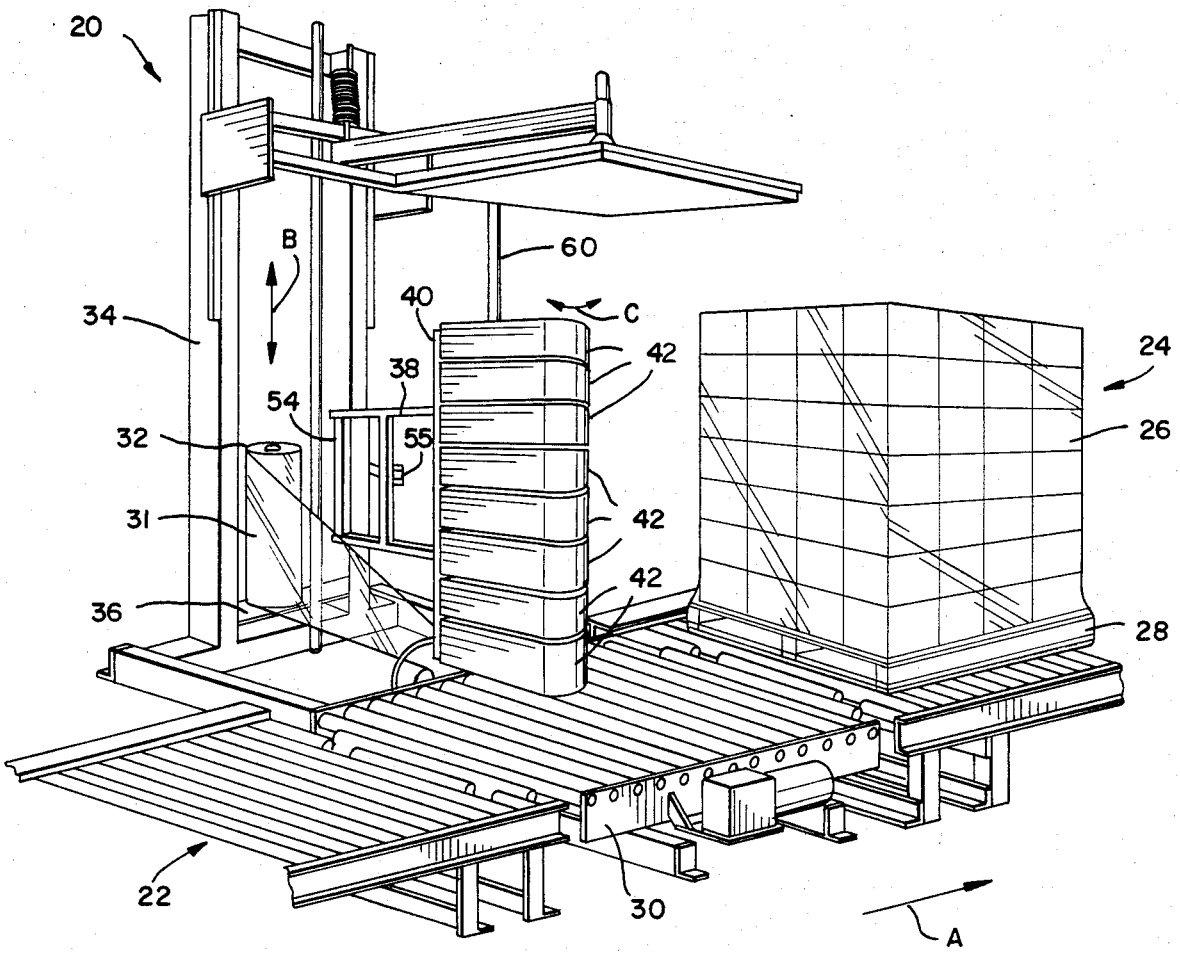
FIG. 1 is a perspective view of a stretch wrapping machine with a wipe down device incorporating the teachings of the present invention.

As embodied and shown in FIG. 1, the apparatus for wiping down a web wrapped on a load is integrated into a stretch wrapping machine 20.

Stretch wrapping machine 20 includes a conveyor 22 for conveying a pallet load 24 along its length. Pallet load 24, before being wrapped, may consist of a plurality of individual sub-units 26 which are stacked on a skid 28 so that they can be unitized by a web of plastic film which is wrapped on pallet load 24 and skid 28 by the stretch wrapping machine 20.

With reference to FIG. 1, pallet load 24 progresses along conveyor 22 in a generally left to right direction indicated by arrow A. Prior to achieving the position shown in FIG. 1, the stacked but unwrapped pallet load 24 stops on turntable 30, which is part of the conveyor 22. Turntable 30 rotates about a vertical axis to rotate pallet load 24 relative to a film web dispenser 32, which is mounted on a frame 34 proximate to conveyor 22. Film web dispenser 32 is suspended by a support 36 which is attached to frame 34 by a rack and pinion drive mechanism to drive film web dispenser 32 in the vertical direction of arrow B along frame 34. This allows pallet load 24 to be wrapped along its full height when the width of the film web 31 is less than the height of the pallet load 24. Film web dispenser 32 dispenses film web 31 in a conventional manner.

According to the present invention, the apparatus includes a wiper support. As shown and embodied in FIG. 1, the wiper support includes a horizontally extending arm 38 and a vertical support bar 40 mounted across one end. The other end of arm 38 is mounted on frame 34 through the use of vertical axle 54, so that arm 38 pivots through an arc of arrow C about a vertical axis. A hydraulic control cylinder 55 (partially obscured) also connects arm 38 and frame 34 and is used to position arm 38 during operation.

According to the present invention, the apparatus also includes a wiper including at least one strip doubled back along its length to form a loop, the loop being flexible in a direction generally parallel to a plane passing through the length of the strip, the wiper being secured to the wiper support and the loop extending from the wiper support for wiping down the web wrapped on the load by relative movement between the wiper support and the web in said direction.

As shown and embodied in FIG. 1, said at least one strip includes a plurality of strips 42 of ultra-high molecular weight plastic, such as those made by DuPont under the names Delron, Ertalon, and Ertalite. According to the present invention, it is preferable that the strip length is substantially greater than the strip width and the width is substantially greater than the strip thickness. As shown and embodied in FIG. 2, each strip 42 is about 30" long, 5" wide, and 1/16" thick and is doubled back along its length to form a loop. The length of the strip, and therefore the loop, is determined by the ranges of variation in product size. Each strip 42 has two end portions 44 and 46 along its width. It is preferable that the two end portions 44 and 46 are both secured to the bar 40 of the wiper support. Fasteners such as rivets 48 can be used for this purpose.

Figure 2:
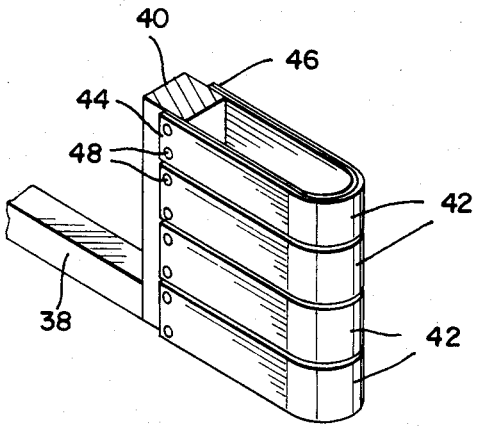
FIG. 2 is a perspective partial view of the wiper and wiper support in the arrangement illustrated in FIG. 1.

Because of the dimensions and mounting of the strip, the loop extending from the wiper support is flexible in a direction generally parallel to a plane passing through the length of the strip, which in FIGS. 1 and 2, would be a horizontally oriented plane. Similarly, because of the dimensions and mounting of the strip, the loop extending from the wiper support is rigid about an axis in the plane passing through the length of the strip. As shown in FIGS. 1 and 2, the loop formed by strips 42 are rigid about an axis lying in a horizontally oriented plane.

The loop is especially rigid about an axis perpendicular to the plane of the drawing in FIG. 2. A result, the loops 42 are extremely resistant to the effects of gravity and do not sag even after a prolonged period of operation.

According to the present invention, it is preferable that said at least one strip includes a plurality of strips mounted adjacent to each other along the wiper support in an array extending generally perpendicular to said direction and are spaced apart from each other.

As shown and embodied in FIGS. 1 and 2, strips 42 are mounted adjacent to each other in an array extending along the vertical extent of support bar 40, and are spaced from each other so as to be independently movable, relative to each other, about a vertical axis.

Figure 3:
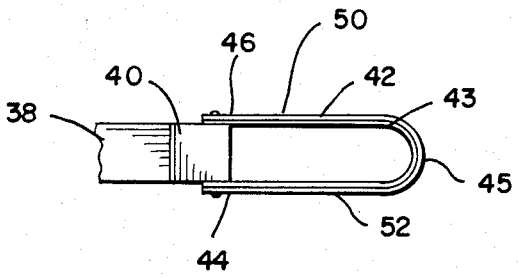
FIG. 3 is a top view of the arrangement shown in FIG. 2 prior to engaging a load.

According to the present invention, it is preferable that said at least one strip includes a nested plurality of strips. As shown in FIG. 3, the nested plurality of strips includes outer strip 42 and inner strip 43 which run parallel to each other, form a loop, and have their ends attached to support bar 40. The use of a nested plurality of strips allows for greater pressure at tip 45 but does not restrict bending when the loop is bent at a tight radius. As a result, tip pressure is maintained when wiping down loads which are positioned far away from the web cutter as shown in FIG. 4A, as well as permitting bending at a tight radius for wider loads positioned closer to the support bar 40.

The use of wiper strips according to the present invention allows a series of loads of varying sizes to be wiped down in a continuous operation without adjusting or varying the wipe down arrangement. The multiple number of strips along the length of the support bar 40 also allow for automatic adaptability to irregular shaped loads.

According to the present invention, it is preferable that said at least one strip includes a plurality of strips mounted adjacent to each other in an array extending generally in said direction. It is preferable that the loop formed by at least one of said plurality of strips extends farther from the wiper support than the loop formed by at least another one of said plurality of strips. It also is preferable that the longer loop is positioned to trail the shorter loop during said movement.

As shown and embodied in FIG. 7, the plurality of strips mounted adjacent to each other in an array extending generally in said direction include strips 42*a* and 42*b* which are mounted side by side in a horizontally extending array. The loop formed by strip 42*b* extends farther from wiper support 38*a* than the loop formed by strip 42*a* and is positioned to trail strip 42*a* in the movement indicated by arrow D. This provides a preferred wiping action over the surface of the load.

According to the present invention, it is preferable that the two end portions of the loop are spaced from each other. As shown in FIG. 3, end portions 44 and 46 are spaced from each other by placing support bar 40 between them and by dimensioning bar 40 to be at least around 1" or 2" in width. This spacing of end portions 44 and 46 further improves the effective range of satisfactory bending characteristics of the loop of strip 42 with regard to loads that are spaced different relative distances from support bar 40 as shown in FIGS. 4A and 4B. It also improves the rolling characteristic of the loop of strip 42 as discussed below in relation to FIG. 5.

According to the present invention, it is preferable that the loop includes two spaced generally parallel portions which extend to a rounded outer portion. As shown and embodied in FIG. 3, generally parallel portions 50 and 52 extend from end portions 44 and 46 out to a rounded outer tip portion 45. These generally parallel portions 50 and 52 can be allowed to diverge substantially more than is shown so that tip 45 is larger and more gently rounded and still be within the scope of this limitation.

According to the present invention, it is preferable that the generally parallel portions of the loop are spaced at a distance substantially less than the distance from the brush support to the outer tip portion. As shown and embodied in FIG. 3, the generally parallel portions 50 and 52 are spaced at a distance substantially less than the distance from support bar 40 to tip 45 in order to accommodate a wide range of load widths.

According to the present invention, it is preferable that the apparatus include means for pivoting the wiper support solely about an axis generally perpendicular to a plane passing through the length of the strip to wipe down the web with a wiper. As shown in FIG. 1, the means for pivoting the wiper support includes vertically extending axle 54 mounted on frame 34 and attached to arm 38 to allow arm 38 to pivot through the arc of arrow C.

According to the present invention, the apparatus includes means for moving the web and load generally in a straight line relative to the wiper support to wipe down the web with the wiper. As shown and embodied in FIG. 1, the means for moving the web and load relative to the wiper support includes conveyor 22 which moves load 24 and the web wrapped on it generally in a straight line past wiper support bar 40.

According to the present invention, the apparatus preferably includes means for dispensing a web to be wrapped on a load, means for rotating the load relative to the dispenser means and means for moving the load wrapped with the web relative to the wiper support to wipe down the web with the wiper.

As shown and embodiment in FIG. 1, the means for dispensing the web includes a film web dispenser 32 having an arrangement for supporting and dispensing a film web 31. The means for rotating the load relative to the dispenser means includes turntable 30, which rotates load 24 about a vertical axis when load 24 is positioned on turntable 30 causing film web 31 to be wrapped on load 24. Alternatively, the means for rotating the load relative to the web dispenser may include an arrangement for revolving the web dispenser around the load in the manner shown in U.S. Pat. No. 4,545,182 to McDowell, Jr. and assigned to Lantech, Inc. which is incorporated herein by reference. The means for moving the load relative to the wiper support includes conveyor 22 which moves load 24 past wiper support bar 40.

According to the present invention, it is preferable that the apparatus include means for clamping and cutting the web of the wrapped load, and wherein the cutting means is mounted on the wiper support.

Figure 6A:
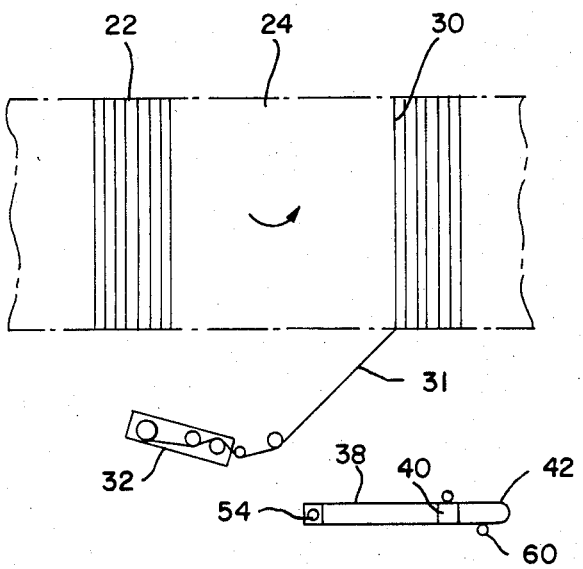
FIGS. 6A through 6D are schematic top views of the arrangement shown in FIG. 1 illustrating a sequence of operation.
Figure 6B:
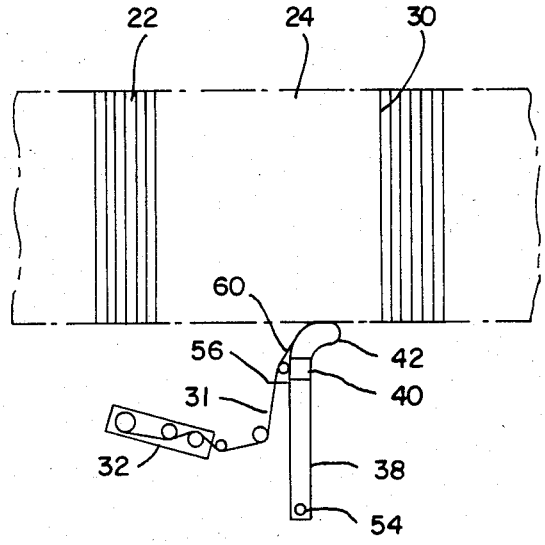

As shown in FIG. 6B, the clamping means includes clamps 56, which are, in and of themselves, conventional clamps used in stretch wrapping machines such as those described in the patents incorporated by reference herein. The cutting means includes a blade or hot wire 58 mounted on support bar 40 which has a structure and operation which is conventional such as that shown in the patents incorporated by reference herein.

According to the present invention, there is provided a method for wiping down a web after wrapping a load with the web comprising: positioning a load in a position to be wrapped; rotating the load relative to a web dispenser to wrap the web on the load; clamping and cutting the web after the rotating step; and moving the wrapped load relative to a wiper support on which a looped strip wiper is mounted, to wipe down the web with the looped strip wiper.

Such a method is shown embodied in the sequence of operation shown in FIGS. 6A through 6D. In FIG. 6A, load 24 is positioned on turntable 30 (not shown in FIG. 6A, but shown in FIG. 1) and rotated by turntable 30 relative to film web dispenser 32 to wrap film 31 onto load 24. Alternatively, the step of rotating the load relative to the web dispenser may be accomplished by revolving the web dispenser around the load in the manner shown in U.S. Pat. No. 4,545,182 to McDowell, Jr. and assigned to Lantech, Inc. which is incorporated herein by reference.

Figure 6C:
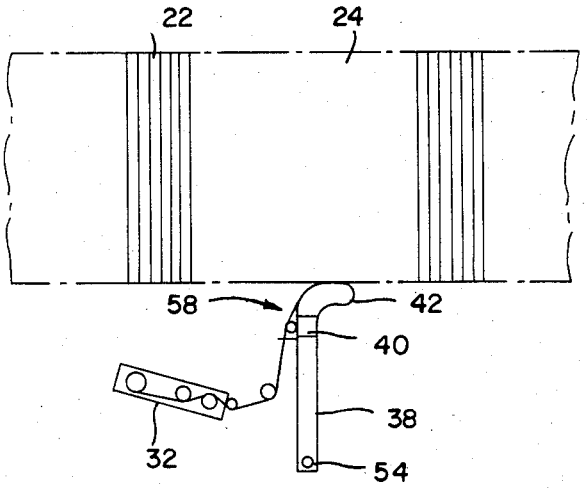

Arm 38 is pivoted from the position shown in FIG. 6A to the position shown in FIG. 6B after load 24 stops rotating, and film web 31 is clamped with clamps 56 and cut as shown in FIG. 6C with cutters 58.

The step of moving the wrapped load relative to a wiper support on which a looped strip wiper is mounted, to wipe down the web with a looped strip wiper, is shown by pivoting arm 38 about axle 54, which has a vertical orientation. The moving step can also or alternatively include moving load 24 past extended arm 38 as shown in the motion from FIG. 6C and to FIG. 6D.

According to the present invention, it is preferable that the moving step includes pivoting the wiper support solely about one axis. As shown and embodied in FIGS. 6A and 6B, arm 38 is pivoted about axle 54 which is mounted along a vertical axis. By pivoting the wiper support solely about one axis, the present invention accomplishes, with less mechanical movement and attendant cost, the same function as was previously required by multiple articulation brush arrangements. It is possible to use a single articulation process because of the extended range of operation of the wiper according to the present invention.

Figure 6D:
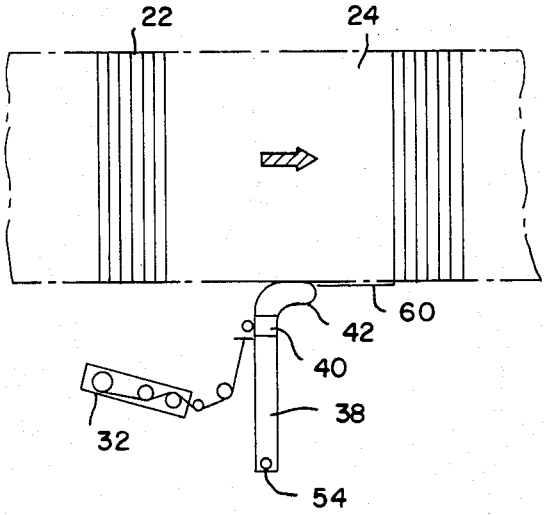

According to the present invention, it is preferable that the moving step includes conveying the load past the wiper support. As shown in FIGS. 6C and 6D, load 24 is conveyed along conveyor 22 past wiper support arm 38. As a result, the load's movement off turntable 24 is used to complete the wipe down as the wiper maintains contact against the load.

According to the present invention, it is preferable that the method includes resetting the orientation of the wiper relative to the wiper support after the moving step.

As shown in FIG. 6A, wiper strips 42 return from the position shown in FIG. 6D and are forced against rod 60 (also shown in FIG. 1) to reorient wiper strips 42 to their original angle of extent from support bar 40.

According to one embodiment of the method, it is preferable to maintain contact between the looped strip wiper and the web in fixed relation while moving the wiper support relative to the web to wipe down the web by rolling the looped strip wiper over the web. As shown and embodied in the sequence of operation in FIGS. 5A and 5B, arm 38 is pivoted while maintaining non-sliding contact between looped strip 42 and the web and load which it contacts such that the loop rolls in non-sliding contact over the web and load when pivoted from the position shown in FIG. 5A to the position shown in FIG. 5B.

In addition to the methods shown and embodied in FIGS. 5A through 5B and FIGS. 6A through 6D, other steps may be made, such as allowing arm 38 to pivot through a 180° sweep. In such an arrangement, the motion of the load exiting the turntable would not be needed to complete the wipe down as is required in the operation shown in FIGS. 6A through 6D.

Among the advantages of the present arrangement are its adaptability to normal stretch wrapping machines without substantial alteration. It lacks the fatigue in vertical bending which is present in conventional wipers. The loops conform to the shape of products, insuring a wipe down along the whole width of the film tail. The arrangement can handle a considerable range of off-sets in load size, at least of 10" to 15". A 90° sweep of the wiper may be used to reduce the movement in the wrap cycle or a 180° sweep may be used to eliminate the need to have the motion of the load exiting the system to complete the wipe down. The loop shape affords adequate pressure on the tail of the film over an extensive range of product variation, particularly at the tip of the loop where the product is away from the cutter.

Additional advantages and modifications will readily occur to those skilled in the art. The invention in its broader aspects is, therefore, not limited to the specific details, representative apparatus and illustrative examples shown and described. Accordingly, departures may be made from such details without departing from the scope or spirit of the general inventive concept as defined by the appended claims and their equivalents.

What is claimed is:

1. Apparatus for wrapping a web on a load and wiping down the web after it has been wrapped on the load comprising:

means for dispensing a web to be wrapped on a load;

means for rotating the load relative to the dispenser means to wrap the web on the load;

a wiper support; and a wiper including at least one strip doubled back along its length to form a loop, the loop being flexible in a direction generally parallel to a plane passing through the length of the strip, the wiper being secured to the wiper support and the loop extending from the wiper supports for wiping down the web wrapped on the load by relative movement between the wiper support and the web in said direction.

2. The apparatus of claim 1, wherein the loop is rigid about an axis in said plane.

3. The apparatus of claim 1, wherein the loop includes two end portions which both are secured to the wiper support.

4. The apparatus of claim 1, wherein the strip length is substantially greater than the strip width.

5. The apparatus of claim 1, wherein the strip width is substantially greater than the strip thickness.

6. The apparatus of claim 1, wherein said at least one strip includes a plurality of strips mounted adjacent to each other along the wiper support in an array extending generally perpendicular to said direction.

7. The apparatus of claim 6, wherein the plurality of strips are spaced apart from each other.

8. The apparatus of claim 1, wherein said at least one strip includes a nested plurality of strips.

9. The apparatus of claim 1 wherein said at least one strip includes a plurality of strips mounted adjacent to each other in an array extending generally in said direction.

10. The apparatus of claim 9 wherein the loop formed by at least one of said plurality of strips extends farther from the wiper support than the loop formed by at least another one of said plurality of strips.

11. The apparatus of claim 10 wherein the longer loop is positioned to trail the shorter loop during said movement.

12. The apparatus of claim 3, wherein said two end portions are spaced from each other.

13. The apparatus of claim 1, wherein said at least one strip is an ultra-high molecular weight plastic.

14. The apparatus of claim 1, wherein the loop includes two spaced generally parallel portions which extend to a rounded outer tip portion.

15. The apparatus of claim 14, wherein the generally parallel portions of the loop are spaced at a distance substantially less than the distance from the wiper support to the outer tip portion.

16. The apparatus of claim 1 including means for pivoting the wiper support solely about an axis generally perpendicular to said plane to wipe down the web with the wiper.

17. The apparatus of claim 1 including means for moving the web and load generally in a straight line relative to the wiper support to wipe down the web with the wiper.

18. The apparatus of claim 1 including means for clamping and cutting the web of the wrapped load.

19. The apparatus of claim 18, wherein the cutting means is mounted on the wiper support.

20. A method for wrapping a web on a load and wiping down the web after it has been wrapped on the load comprising:

positioning a load in a position to be wrapped;

rotating the load relative to a web dispenser to wrap the web on the load;

moving the wrapped load relative to a wiper support on which a looped strip wiper is mounted; and wiping down the web wrapped on the load with the loop of the looped strip wiper during the moving step.

21. The method of claim 20, wherein the moving step includes pivoting the wiper support solely about one axis.

22. The method of claim 20, wherein the moving step includes conveying the load past the wiper support.

23. The method of claim 21, wherein the moving step includes conveying the load past the wiper support after the pivoting step.

24. The method of claim 20 including resetting the orientation of the wiper relative to the wiper support after the moving step.

25. The method of claim 20 including maintaining contact between the looped strip wiper and the web in fixed relation while moving the wiper support relative to the web to wipe down the web by rolling the looped strip wiper over the web.

26. The method of claim 20 including clamping and cutting the web after the rotating step.

* * * * *